United States Patent [19]

Camisa

[11] Patent Number: 4,810,329

[45] Date of Patent: Mar. 7, 1989

[54] COMPOSITE FLOORING FELT FOR VINYL FLOORING CONTAINING LATEXES AND AN ACTIVATOR

[75] Inventor: John D. Camisa, Midland, Mich.

[73] Assignee: The Dow Chemical Company, Midland, Mich.

[21] Appl. No.: 94,183

[22] Filed: Sep. 8, 1987

[51] Int. Cl.[4] ..... D21H 3/38

[52] U.S. Cl. ..... 162/168.1; 162/145; 162/146; 162/152; 162/157.2; 162/168.2; 162/169; 162/181.1; 162/183

[58] Field of Search ..... 162/145, 152, 146, 157.1, 162/157.2, 156, 168.1, 168.2, 169, 164.6, 181.1, 183

[56] References Cited

U.S. PATENT DOCUMENTS

| | | | |
|---|---|---|---|
| 3,772,076 | 11/1973 | Keim | 162/169 |
| 4,225,383 | 9/1980 | McReynolds | 162/145 |
| 4,609,431 | 9/1986 | Grose et al. | 162/145 |
| 4,707,221 | 11/1987 | Beer et al. | 162/169 |

*Primary Examiner*—Peter Chin

[57] ABSTRACT

The present invention is a composite flooring felt for vinyl flooring containing a blend of latexes and an activator. Also included is a process for preparing the flooring felt composite. The process can additionally contain a wet strength resin and a flocculant.

8 Claims, No Drawings

COMPOSITE FLOORING FELT FOR VINYL FLOORING CONTAINING LATEXES AND AN ACTIVATOR

BACKGROUND OF THE INVENTION

Vinyl flooring has two parts, a vinyl portion and a flooring felt portion (made from fiber, filler and a latex binder). The vinyl contains a plasticizer such as dioctyl phthalate or butyl benzyl phthalate which is necessary to soften the vinyl during processing. The vinyl and plasticizer are called the plastisol. The consequence is the plasticizer weakens the latex in the felt composite when the plastisol is combined with the felt composite.

The plasticizer also weakens the felt composite itself. The hot tensile property (strength of felt composite at high temperatures) is affected by the presence of the plasticizer. The felt composite provides the integrity for the plastisol such that the felt composite must remain strong and not stretch during the process of fusion of the vinyl. Fusion occurs at high temperatures when after the plastisol is contacted with the felt composite, the plasticizer penetrates into the vinyl to give the vinyl integrity. The plasticizer increases the flexibility of the felt composite causing undesirable wrinkling and stretching (plasticized elongation) resulting in distorted patterns (misregistration) on the resultant vinyl flooring.

The retention properties and drainage properties of the aqueous dispersion used to make the felt composite must also be within a range to optimize the runnability of the felt composite on common papermaking equipment.

Preparing a felt composite having plasticizer stiffness and reduced elongation as well as improved retention and drainage properties for processing would therefore, be desirable.

SUMMARY OF THE INVENTION

Accordingly, the present invention is a felt composite useful for flooring felt having improved properties for vinyl flooring which comprises:

(a) a filler;

(b) a fiber or fibers;

(c) a first latex polymer selected from the group consisting of: an acrylate copolymer; a copolymer of a monovinylidene monomer and an acyclic conjugated diene; or a copolymer of a monovinylidene monomer and an $\alpha,\beta$-ethylenically unsaturated carboxylic acid ester; and (d) a second latex polymer comprising $\alpha,\beta$-ethylenically unsaturated carboxylic acid monomers and suitable nonionic vinyl monomers wherein the $\alpha,\beta$-ethylenically unsaturated carboxylic acid monomers are present in an amount of from about 10 to about 50 weight percent based on total monomers of the second latex polymer; and (e) a poly(dimethyl diallyl ammonium chloride) activating agent having a compound of the formula:

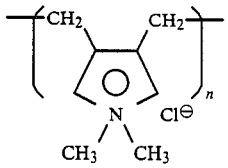

wherein n=600–3500, in an amount sufficient to render improved plasticizer stiffness and elongation to the flooring felt.

Another aspect of the present invention is a process for preparing flooring felt which comprises:

(a) preparing a slurry comprising:

(i) fibers in an amount of from about 5 to about 75 weight percent based on the dry weight of the felt composite;

(ii) a filler in an amount of from about 10 to about 85 weight percent based on the total dry weight of the felt composite;

(iii) a wet strength resin in an amount of from about 0 to about 1 weight percent of total composite based on dry weight of composite; and (iv) an activating agent, poly(dimethyl diallyl ammonium chloride) in an amount sufficient to render improved plasticizer stiffness and elongation to the flooring felt, said activating agent having a compound of the formula:

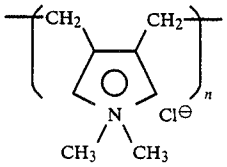

wherein n=600–3500

(b) adjusting the pH of the slurry to from about 6 to about 12;

(c) contacting the slurry to form an aqueous dispersion, with a blend of a first latex polymer selected from the group consisting of: an acrylate copolymer; a copolymer of a monovinylidene monomer and an acyclic conjugated diene; or a copolymer of a monovinylidene monomer and an $\alpha,\beta$-ethylenically unsaturated carboxylic acid ester; and a second latex polymer comprising $\alpha,\beta$-ethylenically unsaturated carboxylic acid monomers and suitable nonionic vinyl monomers wherein the $\alpha,\beta$-ethylenically unsaturated carboxylic acid monomers are present in an amount of from about 10 to about 50 weight percent based on total monomers of the second latex polymer, wherein the first and second latexes are present in an amount of from about 7 to about 25 weight percent of the felt composite, based on the dry weight of the total felt composite;

(d) distributing and draining the aqueous dispersion on a porous substrate such as a wire to form a wet web; and (e) drying the web.

Yet another aspect of the present invention is the further addition of a flocculatnt to the aqueous dispersion to colloidally destablilize the resultant mixture to form a fibrous agglomerate in aqueous suspension which improves processing properties such as retention and drainage.

Still another aspect of the present invention is the order of latex addition to the felt composite slurry. The preferred order of addition results in improved retention properties and drainage properties of the wet web used to make the felt composite which optimizes the runnability of the wet web on a common paper-making equipment. Such a process for preparing flooring felt comprises:

(a) preparing a slurry comprising:
  (i) fibers in an amount of from about 5 to about 75 weight percent based on the dry weight of the felt composite;
  (ii) a filler in an amount of from about 10 to about 85 weight percent based on the total dry weight of the felt composite;
  (iii) a wet strength resin in an amount of from about 0 to about 1 weight percent of total composite based on dry weight of composite;
  (iv) an activating agent, poly(dimethyl diallyl ammonium chloride) in an amount sufficient to render improved plasticizer stiffness and elongation to the flooring felt composite, said activating agent having a compound of the formula:

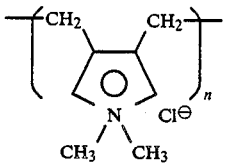

wherein n=600–3500

(b) adjusting the pH of the slurry from about 6 to about 12;

(c) contacting the slurry to form an aqueous dispersion, with a blend of latex having
  (i) a first portion of a first latex polymer selected from the group consisting of: an acrylate copolymer; a copolymer of a monovinylidene monomer and an acyclic conjugated diene; or a copolymer of a monovinylidene monomer and an $\alpha,\beta$-ethylenically unsaturated carboxylic acid ester; and
  (ii) a second latex polymer comprising $\alpha,\beta$-ethylenically unsaturated carboxylic acid monomers and suitable nonionic vinyl monomers wherein the $\alpha,\beta$-ethylenically unsaturated carboxylic acid monomers are present in an amount of from about 10 to about 50 weight percent based on total monomers of the second latex polymer; and
  (iii) a flocculant in an amount of from about 0.5 lbs/ton solids to about 6 lbs/ton solids based on the dry weight of the total felt composite;

(d) contacting the resultant aqueous dispersion with a second portion of the first latex polymer in an amount of from about 6 to about 70 weight percent of the total amount of first latex added, wherein the total amount of latex present in the felt composite is in an amount of from about 7 to about 25 weight percent of the felt composite, based on the dry weight of the total felt composite;

(e) distributing and draining the aqueous dispersion on a porous substrate such as a wire to form a wet web; and (f) drying the web.

DETAILED DESCRIPTION OF THE INVENTION

A. The Filler

The flooring felt of the present invention will contain conventional fillers known to one skilled in the art. Typically such fillers are finely-divided essentially water-insoluble inorganic materials. Such materials include for example, talc, calcium carbonate, clay, titanium dioxide, amorphous silica, zinc oxide, barium sulfate, calcium sulfate, aluminum silicate, magnesium silicate, diatomaceous earth, aluminum trihydrate, magnesium carbonate, partially calcined dolomitic limestone, magnesium hydroxide and mixtures of two or more of such materials.

The filler is added in amount of from about 10 to about 85 weight percent based on the total dry weight of the felt composite. Preferably, the filler is added at an amount of from about 60 to about 75 weight percent based on the total dry weight of the felt composite.

B. The Fiber

The fiber is any water-insoluble, natural or synthetic water-dispersible fiber or blend of such fibers. Usually water-dispersibility is provided by a small amount of ionic or hydrophilic groups or charges which are of insufficient magnitude to provide water-solubility. Either long or short fibers, or mixtures thereof, are useful, but short fibers are preferred. Many of the fibers from natural materials are anionic, e.g., wood pulp. Some of the synthetic fibers are treated to make them slightly ionic, i.e., anionic or cationic. Glass fibers, chopped glass, blown glass, reclaimed waste papers, cellulose from cotton and linen rags, mineral wool, synthetic wood pulp such as is made from polyethylene, polypropylene, straws, ceramic fiber, nylon fiber, polyester fiber, and similar materials are useful. Particularly useful fibers are the cellulosic and lignocellulosic fibers commonly known as wood pulp of the various kinds from hardwood and softwood such as stone ground wood, steam-heated mechanical pulp, chemomechanical pulp, semichemical pulp and chemical pulp. specific examples are unbleached sulfite pulp, bleached sulfite pulp, unbleached sulfate pulp and bleached sulfate pulp.

Cellulose, fiberglass, polyester, polyethylene and polypropylene are preferred fibers included in the felt composite. The fibers are typically included in an amount of from about 5 to about 75 weight percent based on the dry weight of the felt composite.

C. The First Latex Polymer (i) Comprising a Monovinylidene Monomer and an Acyclic Aliphatic Conjugated Diene Monomer The Monovinylidene Monomer The term "monovinylidene monomer" is intended to include those monomers wherein a radical of the formula:

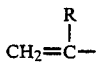

(wherein R is hydrogen or a lower alkyl such as an alkyl having from 1 to 4 carbon atoms) is attached directly to an aromatic nucleus containing from 6 to 10 carbon atoms, including those wherein the aromatic nucleus is substituted with alkyl or halogen substituents. Typical of these monomers are styrene, $\alpha$-methylstyrene, ortho-, meta- and para-methylstyrene; ortho-, meta- and para-ethylstyrene; o,p-dimethylstyrene; o,p-diethylstyrene;

isopropylstyrene; o-methyl-p-isopropylstyrene; p-chlorostyrene; p-bromostyrene; o,p-dichlorostyrene; o,p-dibromostyrene; vinylnaphthalene; diverse vinyl (alkylnaphthalenes) and vinyl (halonaphthalenes) and comonomeric mixtures thereof.

The monovinylidene monomer can be present in an amount of from about 20 to about 80 weight percent based on the weight of the first latex copolymer. Preferably, monovinylidene monomer is present in an amount of from about 40 to about 60 weight percent based on the weight of the first latex copolymer.

The Acyclic Aliphatic Conjugated Diene Monomer

"Acyclic aliphatic conjugated dienes" usefully employed herein include typically those compounds which have from about 4 to about 9 carbon atoms, for example, 1,3-butadiene, 2-methyl-1,3-butadiene; 2,3-dimethyl-1,3-butadiene; pentadiene; 2-neopentyl-1,3-butadiene and other hydrocarbon analogs of 2,3-butadienes, such as 2-chloro-1,3-butadiene; 2-cyano-1,3-butadiene, the substituted straight chain conjugated pentadienes, the straight chain and branched chain conjugated hexadienes, other straight and branched chain conjugated dienes having from 4 to about 9 carbon atoms, and comonomeric mixtures thereof. The 1,3-butadiene hydrocarbon monomers, such as those mentioned hereinbefore, provide interpolymers having particularly desirable properties and are therefore preferred. The cost, ready availability and the excellent properties of interpolymers produced therefrom makes 1,3-butadiene the most preferred acyclic aliphatic conjugated diene.

The conjugated diene can be present in an amount from about 80 to about 20 weight percent based on the weight of the first latex copolymer. Preferably the conjugated diene is present in an amount from about 40 to about 50 weight percent based on the weight of the first latex copolymer.

An $\alpha,\beta$-ethylenically unsaturated carboxylic acid may also be incorporated. such $\alpha,\beta$-ethylenically unsaturated carboxylic acids include compositions of the formula:

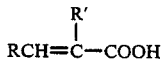

where

R is H and R′ is H, $C_1$–$C_4$ alkyl, or —$CH_2COOX$;

R is —COOX and R′ is H or —$CH_2COOX$; or,

R is $CH_3$ and R′ is H; and

X is H or $C_1$—$C_4$ alkyl.

Suitable $\alpha,\beta$-ethylenically unsaturated aliphatic carboxylic acids are monoethylenically unsaturated monocarboxylic, dicarboxylic and tricarboxylic acids having the ethylenic unsaturation alpha-beta to at least one of the carboxyl groups and similar monomers having a higher number of carboxyl groups. It is understood that the carboxyl groups may be present in the acid or salt from (—COOM in which M represents hydrogen or a metal, such as for example, sodium or potassium) and are readily interconvertible by well known simple procedures.

Specific examples of the $\alpha,\beta$-ethylenically unsaturated aliphatic carboxylic acids are acrylic acid, methacrylic acid, fumaric acid, itaconic acid, maleic acid, aconitic acid, various $\alpha$-substituted acrylic acids such as $\alpha$-ethacrylic acid, $\alpha$-propyl acrylic acid and $\alpha$-butyl acrylic acid.

The latex polymer comprising: a monovinylidene monomer and an acyclic conjugated diene can be present in an amount from about 60 to about 90 weight percent based on the weight of the total latex present in the felt composite and preferably is present in an amount of about 70 weight percent based on total latex present in the felt composite.

(ii) The First Latex Polymer Comprising a Monovinylidene and an Ester of an $\alpha,\beta$-Ethylenically Unsaturated Carboxylic Acid The first latex polymer can also suitably comprise a polymer of a monovinylidene as defined herein above and an ester of an $\alpha,\beta$-ethylenically unsaturated carboxylic acid as defined herein below. An $\alpha,\beta$-ethylenically unsaturated carboxylic acid termonomer can also be incorporated into the latex copolymer.

(iii) The First Latex Polymer Comprising Acrylates

The first latex polymer can also be selected from acrylates which includes monomers of the acrylate or methacrylate type. Additionally, the acrylates can include acids, esters, amides, and substituted derivatives thereof. Generally, the preferred acrylates are $C_1$–$C_8$ alkyl acrylates or methacrylates. Examples of such acrylates include butyl acrylate, 4-biphenyl acrylate, hexyl acrylate, tertbutyl acrylate, methylmethacrylate, butylmethacrylate, lauryl methacrylate, hexylmethacrylate, isobutylmethyacrylate, and isopropylmethacrylate. The preferred acrylates are butyl acrylate and methylmethacrylate.

D. The Second Latex Polymer Comprising an $\alpha,\beta$-ethylenically unsaturated carboxylic acid and suitable nonionic vinyl monomers (i) Carboxylic Acid Monomer The carboxylic acid monomer is typically comprised of a carboxyl containing acrylate which is water-swellable at a pH of at least 6. Representative carboxylic acid monomers is a 10 to 50 weight percent based on total monomers of the second latex polymer of a $C_3$–$C_8$ $\alpha,\beta$-ethylenically unsaturated carboxylic acid monomer of the formula:

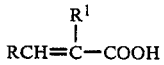

where

R is H and $R^1$ is H, $C_1$–$C_4$ alkyl, or —$CH_2COOX$; R is —COOX and $R^1$ is H or —$CH_2COOX$; or R is $CH_3$ and $R^1$ is H; and X is H or $C_1$–$C_4$ alkyl.

Acrylic or methacrylic acid or a mixture thereof with itaconic or fumaric acid are preferred, but crotonic and aconitic acid and half esters of these and other polycarboxylic acids, such as maleic acid with $C_1$–$C_4$ alkanols, are also suitable, particularly if used in minor amount in combination with acrylic or methacrylic acid. For most purposes, it is preferable to have at least about 10 weight percent, more preferably 20 weight percent carboxylic acid monomer based on the weight of the second latex copolymer.

(ii) Nonionic Vinyl Monomer

To provide the extended polymer backbone for the second latex polymer requires about 50 to 90 weight percent of at least one copolymerizable nonionic $C_2$–$C_{12}$ $\alpha,\beta$-ethylenically unsaturated monomer selected from the group consisting of the formula $$CH_2{=}CYZ$$

where

Y is H and Z is —COOR, —$C_6H_4R'$, CN, Cl, or —CH=$CH_2$;

Y is $CH_3$ Z is —COOR, —$C_6H_4R'$, CN or —CH=$CH_2$; or

Y and Z are Cl; and

R is $C_1$–$C_8$ alkyl or $C_2$–$C_8$ hydroxyalkyl;

R' is H, Cl, Br, or $C_1$–$C_4$ alkyl; and

R'' is $C_1$–$C_8$ alkyl.

Typical of such monomers are the $C_1$–$C_8$ alkyl and $C_2$–$C_8$ hydroxyalkyl ester of acrylic and methacrylic acid including ethyl acrylate, ethyl methacrylate, methyl methacrylate, 2-ethylhexyl acrylate, butyl acrylate, butyl methacrylate, 2-hydroxyethyl acrylate, 2-hydroxybutyl methacrylate; styrene, vinyltoluene, t-butylstyrene, isopropylstyrene, and p-chlorostyrene; vinyl acetate, vinyl butyrate, vinyl caprolate; acrylonitrile, methacrylonitrile, butadiene, isoprene, vinyl chloride, vinylidene chloride, and the like. In practice, a monovinyl ester such as ethyl acrylate or a mixture thereof with styrene, hydroxyethyl acrylate, acrylonitrile, vinyl chloride or vinyl acetate is preferred.

These monomers, of course, must be copolymerizable with the carboxylic acid. Normally about 50 to 90 weight percent, and preferably about 80 weight percent of nonionic vinyl monomer, based on total weight of monomers, is used in preparing the copolymer.

The second latex polymer can comprise from about 10 to about 50 weight percent based on the weight of the total latex present in the felt composite and preferably comprises from about 30 to about 40 weight percent based on total latex present in the felt composite. Most preferably the the amount of the second latex polymer is about 30 weight percent based on the weight of the total latex present in the felt composite.

The amount of total latex present in the felt composite can typically vary from about 7 to about 25 weight percent of the felt composite, based on the dry weight of the total felt composite. Preferably the amount of total latex present in the felt composite is from about 11 to about 17 weight percent of the felt composite, based on the dry weight of the total felt composite.

In the preparation of many of the latexes of different compositions useful in the invention, it is advantageous to use a chain transfer agent of known kinds such as, but not restricted to, the various long chain mercaptans, bromoform, and carbon tetrachloride.

E. The Activator the activator is a polydiallyldimethylammonium chloride which is represented by the following formula.

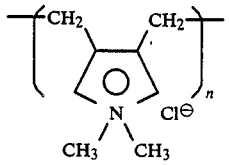

wherein n=600–3500. The viscosity CPS at 25° C. of the activator can be from about 100 to about 200 and more preferably the viscosity CPS can be from about 600 to about 900.

The activator is present in the felt composite in an amount sufficient to render improved plasticizer stiffness and elongation to the flooring felt composite. Typically such an amount is from about 25 to about 60 weight percent based on the weight of the second latex polymer. Preferably, the activator is present in the felt composite in an amount of from about 35 to about 40 weight percent based on the weight of the second latex polymer. Most preferably, the activator is present in the felt composite in an amount of about 37 weight percent based on the weight of the second latex polymer.

F. The pH of the Felt Composite Slurry

The pH of the felt composite slurry will typically be greater than the swelling point of the second latex polymer. Such a pH will typically be from about 6 to about 12. Preferably the pH will be from about 8 to about 10 to maximize the plasticized tensile and minimize the plasticized elongation, imparting a strong flooring felt which resists wrinkling and breakage in the process to make the vinyl felt composite flooring.

The pH can be increased by adding an alkaline additive such as caustic or sodium carbonate. Sodium carbonate is the preferred additive due to safer handling during production.

G. The Wet-Strength Resin

To improve the processing properties a wet-strength resin can be added to the felt composite formulation. Such a wet-strength resin can be any of the conventional wet-strength resins utilized in latex formulations such as adipic acid-diethylene triamineepichlorohydrin.

The wet-strength resin is typically added in an amount of from about 0 to about 1 weight percent of total composite based on dry weight of composite. More preferably, the wet-strength resin is present in the felt composite in an amount of from about 0.05 to about 0.5 weight percent of total composite based on dry weight of composite. Most preferably, the wet-strength resin is present in the felt composite in an amount of about 0.25 weight percent of total composite based on dry weight of composite.

H. The Flocculant

To improve the processing properties a flocculant can be added to the felt composite formulation. Such a flocculant can be any of the conventional flocculants utilized in latex formulations. Representative examples would include: alum, cationic wet strength resins such as adipic acid-diethylene triamine-epichlorohydrin, or cationic polyacrylamide. Preferably, the flocculant is a cationic polyacrylamide made by reacting acrylamide monomer in an amount of from about 75 to about 98 weight percent based on total weight of the polymer with a cationic amine or quaternary ammonium compound such as the methyl chloride quaternary compound of dimethyl aminoethyl acrylate or methacrylate.

Typically, the flocculant is added to the felt composite formulation in an amount of from about 0.5 lbs/ton solids to about 6 lbs/ton solids based on the dry weight of the total felt composite. Preferably, the amount of flocculant added to the felt composite formulation is about 1.5 lbs/ton solids based on the weight of the total felt composite.

Preparing the felt composite

The felt composite formulation is typically prepared by making a slurry of the fibers, the fillers, the wet strength resin and the activating agent. The pH of the slurry is adjusted to from about 6 to about 12. The first and second latexes are then combined and added to the slurry to form an aqueous dispersion. The flocculant can then be added to the resultant aqueous dispersion. The aqueous dispersion is then distributed and drained on a porous substrate such as a wire to form a wet web and the web is dried.

Ordinarily, the filler, the water and the latex are added (usually but not necessarily in that order) to the slurry with agitation. At least some required colloidal destabilization can occur simultaneously with the mixing of the fiber, filler and latex either through interaction of the required components or through the concurrent addition of other optional wet-end additives such as those mentioned below. The mechanical shear caused by mixing and by transfer of the materials through the equipment used can cause, or assist in, the destabilization. An effective and preferred method of carrying out (or completing the carrying out) of the destabilization is the mixing with the other components a flocculating agent, as described herein above. When used, a flocculant is added so that the destabilization can take place before the distributing and draining step.

The temperature of the process through the step of forming the wet web usually is in the range of from about 40° F. (4.4° C.) to about 130° F. (54° C.) although temperatures outside those ranges can be used provided that they are above the freezing point of the aqueous dispersion and are below the temperature at which the latex polymer being used would soften unduly. Sometimes temperatures above ambient conditions promote faster drainage.

A preferred method of preparing the felt composite to optimize the drainage and retention properties of the aqueous dispersion is to prepare the slurry with the fibers, the fillers, and the wet strength resin. Add the activating agent. Adjust the pH of the slurry to from about 6 to about 12. Contact from about 30 to about 94 weight percent of the first latex polymer with the total amount of the second latex polymer to form a blend and add the blend to the slurry to form an aqueous dispersion. Add the remaining portion of the first latex polymer, an amount of from about 6 to about 70 weight percent of the total amount of first latex added. Add a flocculating agent. The aqueous dispersion is then distributed and drained on a porous substrate such as a wire to form a wet web and the web is dried.

Also useful in the practice of this invention are small amounts of various other wet-end additives of the types commonly used in paper-making. Such materials include antioxidants, various hydrocarbon and natural waxes, particularly in the form of anionic or cationic emulsions; cellulose derivatives such as carboxymethylcellulose and hydroxyethyl cellulose; water-soluble organic dyestuffs, water-insoluble but water-dispersible coloring pigments such as carbon black, vat colors and sulfur colors; starch, natural gums such as guar gum and locust bean gum, particularly their anionic and cationic derivatives; non-ionic acrylamide polymers; strength improving resins such as melamine-formaldehyde resins, urea-formaldehyde resins and curing agents of various types such as the sulfur-containing vulcanizing agents and accessory compounds. Further, quantities and/or kinds of anionic or cationic surfactants may also be added in small amounts at various points in the process if desired. Non-ionic surfactants should be used sparingly, if at all.

Optionally, either internal or external sizing can be employed together with the required features of this invention.

The flooring felt of the present invention is typically prepared by conventional methods such as on a handsheet-forming apparatus or common, continuous paper-making equipment such as a Fourdrinier machine, a cylinder machine, suction machines such as a Rotaformer, or on millboard equipment. Suitable also for use in the practice of this invention are other well-known modifications of such equipment, for example, a Fourdrinier machine with secondary headboxes or multicylinder machines in which, if desired, different furnishes can be used in the different cylinders to vary the composition and the properties of one or more of the several plies which can comprise a finished board. For further details, reference is made to the general summary of paper and paper making as found in Kirk-Othmer, *Encyclopedia of Chemical Technology*, Interscience Publishers, Inc., New York, 14 (1967 pages 494–510, with the sheet forming aspect and appropriate equipment therefor being described on pages 505–508.

The densities of the products obtained from the above-described process cover a wide range, such as from about 30 pounds per cubic foot to about 85 pounds per cubic foot. Since the filler constitutes such a high proportion of the weight of the products, the identity of the filler selected for a particular product has considerable effect on the density and other properties of the product.

The thickness of the felt composite which is produced can vary froma bout 15 mils to about 60 mils, the preferred value depending somewhat upon the proposed use. However, the thickness generally is from about 20 mils to about 35 mils.

Description of Test Methods

Drainage Rate

The Drainage Rate is the time in seconds for the slurry diluted with 15,000 ml of water to drain from a 10×12 inch Williams handsheet mold through an 80 mesh screen.

Room temperature, tensile and elongation

Room temperature, tensile and elongation of the felt composite are determined on an Instron using a 6 inch jaw gap, crosshead speed of 5 inches/1 minute. 350° F. Tensile 350° F. Tensile of the felt composite is determined by placing a 1 inch×9 inch piece of felt composite into a 350° F. heated chamber placed between the jaws of an Instron. After one minute at 350° F. the felt composite sample is tested.

Plasticized tensile and elongation

Plasticized tensile and elongation is determined by soaking 1 inch wide stripes of the felt composite in butyl benzyl phthalate for 18 to 24 hours and testing on an Instron.

Plasticized stiffness

Plasticized stiffness is determined by soaking $1\frac{1}{2}\times2\frac{3}{4}$ samples of the felt composite in butyl benzyl phthalate for 18–24 hours and testing on a Taber stiffness tester.

Retention, percent

The materials for the felt composite are added in amounts sufficient to provide felt weighing 45–67 g. Thus, the dry weight of the product also represents the percent retention of solids in the felt.

The invention is further illustrated but is not limited by the following examples wherein all parts and percentages are by weight unless otherwise specified.

EXAMPLES OF FLOORING FELT TO BE USED IN VINY FLOORING

EXAMPLE 1

Into a 2500 ml beaker, place 380 cc of 1.2 percent bleached Kraft Domtar pulp beaten to approximately 500 C.S.F. Add 1000 cc of water at 85° F. While stirring, add 0.162 grams (g) (5 pounds/ton of total solids) Kymene® 557-H (polyamide epichlorohydrin wet strength resin available from Hercules (wet strength resin); 50 g talc and 2 g ⅛ inch polyester fiber. To this add 0.75 g (22 pounds/ton of total solids) Age-floc® WT-40 (poly(dimethyl diallyl ammonium chloride) available from CPS Chemical) (activator) followed by 0.7 g $Na_2CO_3$ to a pH of 10.0. To this add 1.95 g of a 20/24/56 methacrylic acid/ethyl acrylate/methylmethacrylate latex and 7.8 g of a 49/50/1 styrene/-butadiene/itaconic acid latex. Stir for one minute at moderate agitation and add (flocculant) cationic polyacrylamide at 0.2 percent concentration until the latex has been completely flocculated (water clear). Make a 10 inch by 12 inch handsheet of this mixture using a Willims handsheet mold and dry on a Williams dryer for 20 minutes.

COMPARATIVE EXAMPLE

Into a 2500 ml beaker, place 380 cc of 1.2 percent bleached Kraft domtar pulp beaten to approximately 500 C.F.S add 1000 cc of water at 85° F. While stirring, add 0.162 g (5 pounds/ton of total solids) Kymene® 557-H (polyamide epichlorohydrin wet strength resin available from hercules (wet strength resin; 0.162 g Alum; 50 g talc and 2 g ⅛ inch polyester fiber. To this add 9.75 g of a 70 percent/30 percent blend of 54/45/1 styrene/butadiene/fumaric acid and 79/20/1 styrene/-butadiene/fumaric acid. Mix this for one minute under moderate agitation and then add a cationic polyacrylamide flocculant at 0.2 percent concentration until the latex has been completely flocculated (water clear). Make a 10 inch × 12 inch handsheet of this mixture using a Williams Handsheet mold and dry on a Williams dryer for 20 minutes.

$CO_3$. To this add 5.5 g of a blend of 40 percent of 20/24/56 methacrylic acid/ethyl acrylate/methyl methacrylate and 60 percent of the 49/50/1 styrene/-butadiene/itaconic acid latex. The dispersion is mixed for one minute at 1500 rpm on a Cole Palmer Servodyne electric mixer. Then 1.4 lbs/ton of total solids of the cationic polyacrylmide is added and the dispersion is mixed for 30 seconds at 1500 rpm. 1.1 Grams of the styrene/butadiene/itaconic acid latex is added and the dispersion is mixed for an additional minute at 1500 rpm to simulate the shear encountered in pumping stock on a fourdrinier machine. The percent retention and the drainage rate is then tested.

The percent retention of this Example 2 flooring felt is 93.3 percent and the drainage rate is 24 seconds. The percent retention is improved over the Example 1 and comparative Example because the Example 2 sample is mixed at 1500 rpm to simulate the shear encountered in pumping stock on a fourdrinier machine subsequent to percent retention and drainage rate testing. Such shear will cause the percent retention and drainage rate to degrade. Therefore, although the Example 1 and comparative Example retention values from The Table of Results are greater than 97 percent, that data is based on pecent retention without shear. The Example 2 retention is 93.3 percent with shear.

What is claimed is:

1. A felt composite useful for flooring felt having improved properties for vinyl flooring which comprises:

(a) a filler in an amount of at least about 10% by weight based on the total dry weight of the composite;

(b) a fiber in an amount of at least about 5% by weight based on the total dry weight of the composite;

(c) a first latex polymer selected from the group consisting of: an acrylate copolymer; a copolymer of a monovinylidene monomer and an acyclic conjugated diene; or a copolymer of a monovinylidene monomer and an $\alpha,\beta$-ethylenically unsaturated carboxylic acid ester; and Table of Results

| Example | Drainage Rate (seconds) | Room Temp. Tensile (lbs/in) | Percent Elongation at 30 pounds | 350° Tensile lbs/inch | Percent Retention | Taber Stiffness | Stiffness Plasticizer | Tensile Plasticized | Percent Elongation at 10 pounds |
|---|---|---|---|---|---|---|---|---|---|
| Example 1 Flooring Felt | 18 | 40 | 2.0 | 20 | 99.2 | 165 | 145 | 30 | 0.3 |
| Comparative Example | 14 | 44 | 2.3 | 13 | 98.7 | 130 | 43 | 20 | 1.7 |

The data in Table of Results indicates that the felt composite of the Example having the activator demonstrates significantly improved properties over the felt composite of the Comparative Example made without the activator.

EXAMPLE 2 (ORDER OF ADDITION)

A lighter weight (lower caliper) flooring felt is made similarly to Example 1. Into a 2500 ml beaker, place 254 ml of a 1.2 percent bleached Kraft domtar pulp beaten to approximately 500 C.F.S. Add 1000 cc of water at 85° F. While stirring add 0.11 g (g) (5 lbs/ton of total solids) of Kymene® 557-H, 33.5 g talc and 1.3 g of ⅛ inch polyester fibers. To this add 0.46 g (20 lbs/ton of total solids) Age-Floc WT-40 followed by 0.3 g of $Na_2$-

(d) a second latex polymer comprising $\alpha,\beta$-ethylenically unsaturated carboxylic acid monomers and nonionic vinyl monomers wherein the $\alpha,\beta$-ethylenically unsaturated carboxylic acid monomers are present in an amount of from about 10 to about 50 weight percent based on total monomers of the second latex polymer; said first and second latex being present in an amount of at least about 7% by weight based on the total dry weight of the composite, said first latex being present in an amount of about 50% to about 90% by weight based on the total weight of the first and second latexes and (e) a poly(dimethyl diallyl ammonium chloride) activating agent having the formula:

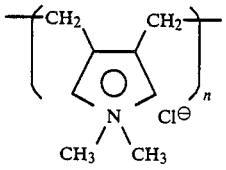

wherein n=600–3500, in an amount sufficient to render improved plasticizer stiffness and elongation to the flooring felt composite.

2. The felt composite of claim 1 further comprising a flocculant.

3. The felt composite of claim 1 wherein the activating agent is present in an amount of from about 25 to about 60 weight percent based on the weight of the second latex copolymer.

4. The felt composite of claim 2 wherein the flocculant is selected from the group consisting of alum, cationic wet strength resins.

5. The felt composite of claim 4 wherein the flocculant is present in an amount of from about 0.5 lbs/ton solids to about 6 lbs/ton solids based on the weight of the total felt composite.

6. The felt composite of claim 5 wherein the amount of the first latex and the second latex is from about 7 to about 25 weight percent of the dry weight of the felt composite.

7. A process for preparing flooring felt which comprises:

(a) preparing a slurry comprising:

(i) fibers in an amount of from about 5 to about 75 weight percent based on the dry weight of the felt composite;

(ii) a filler in an amount of from about 10 to about 85 weight percent based on the total dry weight of the felt composite;

(iii) a wet strength resin in an amount of from about 0 to about 1 weight percent of total composite based on dry weight of composite; and (iv) an activating agent, poly(dimethyl diallyl ammonium chloride) in an amount sufficient to render improved plasticizer stiffness and elongation to the flooring felt, said activating agent having the formula:

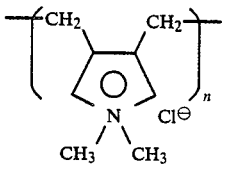

wherein n=600–3500

(b) adjusting the pH of the slurry to from about 6 to about 12;

(c) contacting the slurry to form an aqueous dispersion, with a blend of a first latex polymer selected from the group consisting of: acrylate copolymer; a copolymer of a monovinylidene monomer and an acyclic conjugated diene; or a copolymer of a monovinylidene monomer and an α,β-ethylenically unsaturated carboxylic acid ester; and a second latex polymer comprising α,β-ethylenically unsaturated carboxylic acid monomers and nonionic vinyl monomers wherein the α,β-ethylenically unsaturated carboxylic acid monomers are present in an amount of from about 10 to about 50 weight percent based on total monomers of the second latex polymer, wherein the first and second latexes are present in an amount of from about 7 to about 25 weight percent of the felt composite, based on the dry weight of the total felt composite said first latex being present in an amount of about 50% to about 90% by weight based on the total weight of the first and second latexes.

(d) distributing and draining the aqueous dispersion on a porous substrate such as a wire to form a wet web; and (e) drying the web.

8. A process for preparing flooring felt which comprises: (a) preparing a slurry comprising:

(i) fibers in an amount of from about 5 to about 75 weight percent based on the dry weight of the felt composite;

(ii) a filler in an amount of from about 10 to about 85 weight percent based on the total dry weight of the felt composite;

(iii) a wet strength resin in an amount of from about 0 to about 1 weight percent of total composite based on dry weight of composite;

(iv) an activating agent, poly(dimethyl diallyl ammonium chloride) in an amount sufficient to render improved plasticizer stiffness and elongation to the flooring felt composite, said activating agent having the formula:

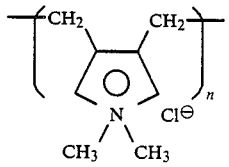

wherein n=600–3500

(b) adjusting the pH of the slurry from about 6 to about 12;

(c) contacting the slurry to form an aqueous dispersion, with a blend of latex having (i) a first portion of a first latex polymer selected from the group consisting of: an acrylate copolymer; a copolymer of a monovinylidene monomer and an acyclic conjugated diene; or a copolymer of a monovinylidene monomer and an α,β-ethylenically unsaturated carboxylic acid ester;

(ii) a second latex polymer comprising α,β-ethylenically unsaturated carboxylic acid monomers and nonionic vinyl monomers wherein the α,β-ethylenically unsaturated carboxylic acid monomers are present in an amount of from about 10 to about 50 weight percent based on total monomers of the second latex polymer; and (iii) a flocculant in an amount of from about 0.5 lbs/ton solids to about 6 lbs/ton solids based on the dry weight of the total felt composite;

(d) contacting the resultant aqueous dispersion with a second portion of the first latex polymer in an amount of from about 6 to about 70 weight percent of the total amount of first latex added, wherein the total amount of latex present in the felt composite is in an amount of from about 7 to about 25 weight percent of the felt composite, based on the dry weight of the total felt composite said first latex being present in an amount of about 50% to about 90% by weight based on the total weight of the first and second latexes;

(e) distributing and draining the aqueous dispersion on a porous substrate such as a wire to form a wet web; and (f) drying the web.

* * * * *

UNITED STATES PATENT AND TRADEMARK OFFICE

CERTIFICATE OF CORRECTION

PATENT NO. : 4,810,329

DATED : March 7, 1989

INVENTOR(S) : John D. Camisa

It is certified that error appears in the above-identified patent and that said Letters Patent is hereby corrected as shown below:

Column 2, line 66, "flocculatnt" should be --flocculant--.

Column 3, line 8, delete the word "a" before the word "common".

Column 4, line 41, "specific" should be --Specific--.

Column 5, line 38, "such" should be --Such--.

Column 6, line 10, "polymer" should be --copolymer--.

Column 7, line 3, in the formula "$CH_3$ Z" should be --$CH_3$ and Z--.

Column 7, line 48, "the" should be --The--.

UNITED STATES PATENT AND TRADEMARK OFFICE

CERTIFICATE OF CORRECTION

PATENT NO. : 4,810,329

DATED : March 7, 1989

INVENTOR(S) : John D. Camisa

It is certified that error appears in the above-identified patent and that said Letters Patent is hereby corrected as shown below:

Column 10, lines 5-6, "Furdrinier" should be --Fourdrinier--.

Column 10, line 28, "froma bout" should be --from about--.

Column 10, line 44, delete "350°F.".

Column 10, line 45, add "350°F." before the word "Tensile".

Column 11, line 2, "IN VINY FLOORING" should be --IN VINYL FLOORING--.

Column 11, line 24, "Willims" should be --Williams--.

Column 11, line 32, "hercules" should be --Hercules--.

Column 11, line 32, "resin;" should be --resin);--

Column 12, line 7, "polyacrylmide" should be --polyacrylamide--.

UNITED STATES PATENT AND TRADEMARK OFFICE

CERTIFICATE OF CORRECTION

PATENT NO. : 4,810,329

DATED : March 7, 1989

INVENTOR(S) : John D. Camisa

It is certified that error appears in the above-identified patent and that said Letters Patent is hereby corrected as shown below:

Column 12, line 25, "pecent" should be --percent--.

Column 12, line 34, insert --or fibers-- after the word "fiber".

Column 13, line 63, insert --an-- after the word "of:".

Signed and Sealed this

Twenty-seventh Day of March, 1990

*Attest:*

JEFFREY M. SAMUELS

*Attesting Officer*

*Acting Commissioner of Patents and Trademarks*